US007204094B2

(12) United States Patent
Cho

(10) Patent No.: US 7,204,094 B2
(45) Date of Patent: Apr. 17, 2007

(54) AIR CONDITIONER

(75) Inventor: Il Yong Cho, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 472 days.

(21) Appl. No.: 10/795,242

(22) Filed: Mar. 9, 2004

(65) Prior Publication Data

US 2005/0044861 A1 Mar. 3, 2005

(30) Foreign Application Priority Data

Aug. 28, 2003 (KR) ..... 10-2003-0059955

(51) Int. Cl.
*F25B 13/00* (2006.01)

(52) U.S. Cl. ..... 62/160; 62/159; 62/277

(58) Field of Classification Search ..... 62/277, 62/278, 510, 159, 160
See application file for complete search history.

(56) References Cited

U.S. PATENT DOCUMENTS 4,774,813 A * 10/1988 Yokoyama ..... 62/81
5,046,323 A * 9/1991 Kuwahara ..... 62/156
5,467,604 A * 11/1995 Sekigami et al. ..... 62/117
6,343,482 B1 * 2/2002 Endo et al. ..... 62/324.6

OTHER PUBLICATIONS

Patent Abstracts of Japan Publication No. 2002-147879.

* cited by examiner

*Primary Examiner*—Cheryl Tyler
(74) *Attorney, Agent, or Firm*—Staas & Halsey LLP

(57) ABSTRACT

An air conditioner having a plurality of outdoor units and a plurality of indoor units with a common piping connected via a common piping to transfer refrigerant therebetween, the air conditioner including a first outdoor unit to provide heat, a second outdoor unit to defrost a heat exchanger of the second outdoor unit, and a first refrigerant guide unit in the second outdoor unit to guide a flowing direction of the refrigerant, wherein the refrigerant discharged from the first outdoor unit is circulated through the heat exchanger of the second outdoor unit.

14 Claims, 7 Drawing Sheets

AIR CONDITIONER

CROSS-REFERENCE TO RELATED APPLICATIONS

This application claims the benefit of Korean Patent Application No. 2003-59955, filed Aug. 28, 2003 in the Korean Intellectual Property Office, the disclosure of which is incorporated herein by reference.

BACKGROUND OF THE INVENTION

1. Field of the Invention

The present invention relates to an air conditioner, which is designed to carry out a defrosting operation for an outdoor heat exchanger by circulating refrigerant therein.

2. Description of the Related Art

Generally, a heat pump type air conditioner carries out a cooling operation or a heating operation in such a way that a flowing direction of refrigerant discharged from a compressor is converted by controlling a four-way valve connected to a discharging outlet of the compressor.

A multi air conditioner, which is adapted to carry out an air conditioning operation for a plurality of rooms, includes a single outdoor unit and a plurality of indoor units connected to the outdoor unit. In the multi air conditioner, a load required by the plurality of indoor units frequently fluctuates, and a range of the fluctuation is broad. Accordingly, since the air conditioner must be equipped with a high-capacity and expensive compressor in order for the single outdoor unit to satisfy a cooling load (or a heating load) required overall by the indoor units, an economical burden is accompanied.

Considering the situation, the air conditioner may be provided with a plurality of outdoor units, to positively cope with the fluctuation of the load required by a plurality of indoor units. Furthermore, pipes connected to the plurality of outdoor units may be shared by the plurality of indoor units, to reduce the pipes transferring the refrigerant.

As the multi air conditioner is operated in a heating mode, heat exchangers of the outdoor units are frosted, thus lowering an efficiency of heat exchange. To prevent the efficiency of heat exchange from declining, the multi air conditioner is operated in a defrosting mode.

In the conventional multi air conditioner, when only one of the plurality of outdoor units is intended to carry out a defrosting operation, the other remaining outdoor units are also set to be operated in the defrosting mode. That is, even if only one outdoor unit in question is required to be operated in the defrosting mode, the other remaining outdoor units must be operated in the defrosting mode together with the one outdoor unit, thereby increasing the number of the defrosting operations carried out. In addition, since outdoor units, which are operating in the heating mode, must be converted into the defrosting mode after the heating mode is stopped, a heating capacity of the multi air conditioner is decreased.

SUMMARY OF THE INVENTION

Accordingly, it is an aspect of the present invention to provide an air conditioner which is designed to carry out a defrosting operation for a heat exchanger of at least one target outdoor unit among a plurality of outdoor units, using refrigerant discharged from the other outdoor units operating in a heating mode.

Additional aspects and/or advantages of the invention will be set forth in part in the description which follows and, in part, will be obvious from the description, or may be learned by practice of the invention.

The above and/or other aspects are achieved by providing an air conditioner having a plurality of outdoor units and a plurality of indoor units connected via a common piping to transfer refrigerant therebetween. The air conditioner includes a first outdoor unit to provide heat, a second outdoor unit to defrost a heat exchanger, and a first refrigerant guide unit in the second outdoor unit to guide a flowing direction of the refrigerant, wherein the refrigerant discharged from the first outdoor unit is circulated through the heat exchanger of the second outdoor unit.

The above and/or other aspects may also be achieved by providing an air conditioner including a first outdoor unit to provide heat, a first compressor in the first outdoor unit, a second outdoor unit to defrost a heat exchanger of the second outdoor unit, a second compressor in the second outdoor unit, a common piping connecting the first outdoor unit and the second outdoor unit, a first refrigerant guide unit in the second outdoor unit to guide a flowing direction of refrigerant, wherein the refrigerant compressed by the first compressor is circulated through the heat exchanger, and a second refrigerant guide unit in the second outdoor unit to guide a flowing direction of the refrigerant, wherein a part of the refrigerant circulated through the heat exchanger is circulated in the second outdoor unit.

The above and/or other aspects may also be achieved by providing an air conditioner having a plurality of outdoor units which share a piping transferring refrigerant therebetween, in which at least one of the plurality of outdoor units provides heat, and at least one heat exchanger of the remaining outdoor units is defrosted using refrigerant discharged from the at least one outdoor unit.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
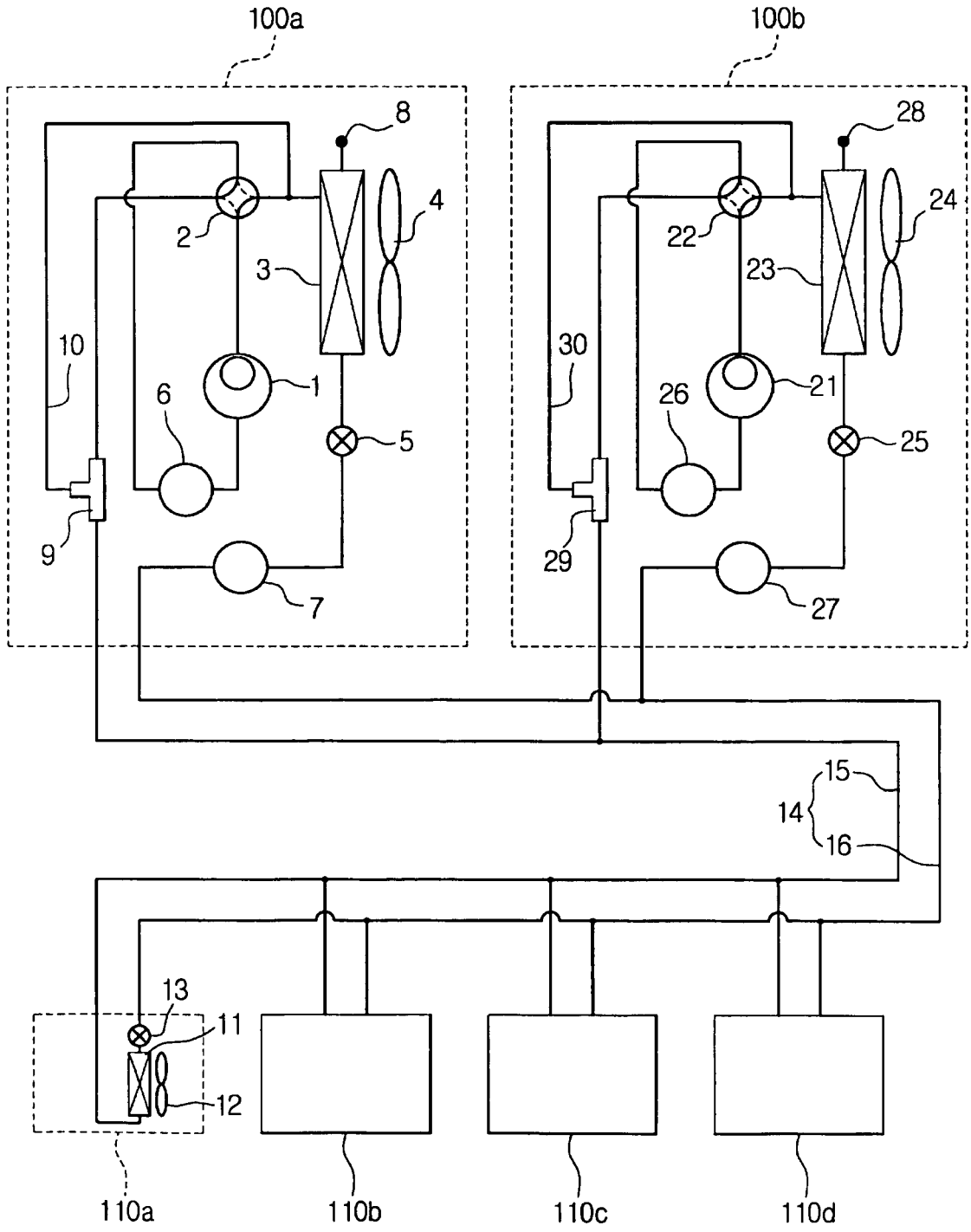
FIG. 1 is a view showing an air conditioner according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

The present invention is directed to a multi air conditioner, including a plurality of outdoor units and a plurality of indoor units, in which the number of the outdoor units and the number of the indoor units are not limited to a fixed number, but may be adjusted, if required.

As shown in FIG. 1, the multi air conditioner according to an embodiment of the present invention includes first and second outdoor units 100*a* and 100*b*, first to fourth indoor units 110*a*, 110*b*, 110*c*, and 110*d*, and a common piping 14. The outdoor units 100*a* and 100*b* and the indoor units 110*a*, 110*b*, 110*c*, and 110*d* are adapted to share the common piping 14 to transfer refrigerant.

Each of the first and second outdoor units 100*a* and 100*b* includes a first refrigerant guide unit to guide a flowing direction of refrigerant. The first refrigerant guide unit includes a bypass line 10 or 30, diverging from the common piping 14 and connected to an inlet of a heat exchanger 3 or 23 of the outdoor unit, and a three-way valve 9 or 29 mounted on an endpoint of the bypass line.

Although the first outdoor unit 100*a* has the same components as those of the second outdoor unit 100*b* in a functional aspect, the corresponding components of the first and second outdoor units 100*a* and 100*b* shown FIG. 1 are indicated with different reference numerals for the sake of simplicity of description.

The first to fourth indoor units 110*a*, 110*b*, 110*c*, and 110*d* have the same components as one another in a functional aspect. More specifically, the first indoor unit 110*a* includes an indoor heat exchanger 11, an indoor fan 12, and an indoor expansion valve 13, and the other indoor units 110*b*, 110*c* and 110*d* also include the same components as those of the first indoor unit 110*a*.

The common piping 14 comprises a common gas pipe 15 and a common liquid pipe 16. Each of the common gas pipe 15 and the common liquid pipe 16 is branched at both sides thereof into a plurality of branch pipes. The branch pipes branched at one side of each of the common gas pipe 15 and the common liquid pipe 16 are connected to the outdoor units 100*a* and 100*b*, and the branch pipes branched at the other side are connected to indoor units 110*a*, 110*b*, 110*c*, and 110*d*.

The first outdoor unit 100*a* includes a compressor 1, a four-way valve 2, the outdoor heat exchanger 3, an outdoor fan 4, an outdoor expansion valve 5, accumulator 6, a receiver 7, and a temperature sensor 8 for the outdoor heat exchanger 3, and the second outdoor unit 100*b* includes a compressor 21, a four-way valve 22, the outdoor heat exchanger 23, an outdoor fan 24, an outdoor expansion valve 25, accumulator 26, a receiver 27, and a temperature sensor 28 for the outdoor heat exchanger 23. The temperature sensors 8 and 28 detect the temperatures of the outdoor heat exchangers 3 and 23, respectively, and send signals corresponding to the detected temperatures of the outdoor heat exchangers 3 and 23 to a microcomputer (not shown) which controls the overall operations of the multi air conditioner. The microcomputer recognizes the temperatures of the outdoor heat exchangers 3 and 23, based on the signals sent from the temperature sensors 8 and 28, and determines whether a defrosting mode is carried out or stopped, based on the temperatures of the outdoor heat exchangers 3 and 23.

As mentioned above, each of the outdoor units 100*a* and 100*b* includes the first refrigerant guide unit. The first refrigerant guide unit includes a bypass line 10 or 30, and a three-way valve 9 or 29 provided at an endpoint of the bypass line.

Each of the first and second outdoor units 100*a* and 100*b* carries out a cooling operation or a heating operation in such a way that a flowing direction of refrigerant discharged from the compressor 1 or 21 is changed by controlling the four-way valve 2 or 22.

Figure 2:
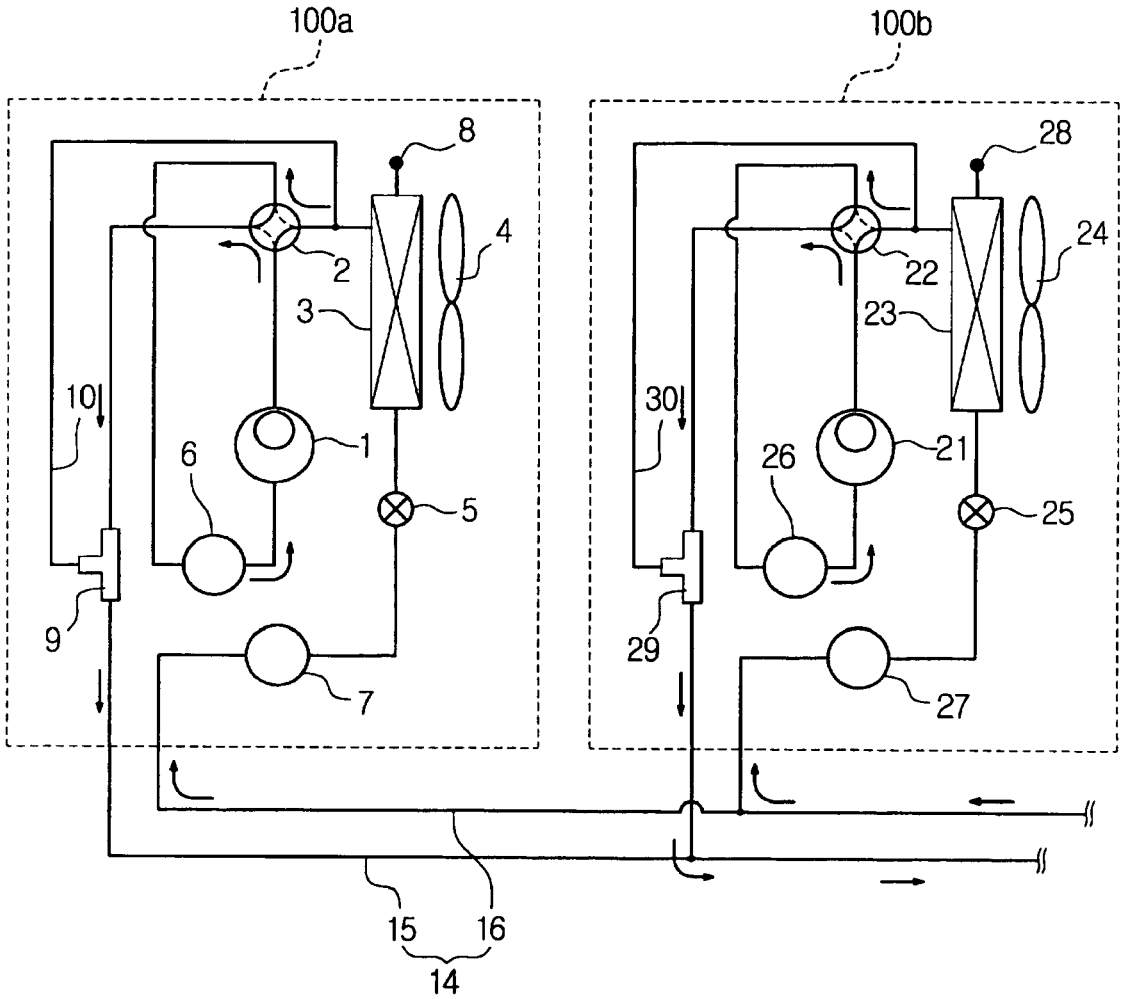
FIG. 2 is a view showing the flow of refrigerant in the air conditioner of FIG. 1 in response to both outdoor units being operated in a heating mode.

FIG. 2 shows the first and second outdoor units 100*a* and 100*b*, both of which are operated in a heating mode.

In this case, high-temperature gas refrigerant, discharged from the compressors 1 and 21, is introduced into the common gas pipe 15 through the three-way valves 9 and 29. Subsequently, the gas refrigerant is changed into liquid refrigerant while passing through the indoor heat exchangers 11 and the indoor expansion valves 13 of the respective indoor units 110*a*, 110*b*, 110*c*, and 110*d* connected to the common gas pipe 15. Thereafter, the liquid refrigerant is vaporized into low-pressure gas refrigerant while passing through the receivers 7 and 27, the outdoor expansion valves 5 and 25, and the outdoor heat exchangers 3 and 23 connected to the common liquid pipe 16. The gas refrigerant is returned to the compressors 1 and 21 through the accumulators 6 and 26, and then discharged therefrom again.

At this point, flow paths of the three-way valves 9 and 29 are set to guide the gas refrigerant, discharged from the compressors 1 and 21, toward the common gas pipe 15. At the same time, bypass lines 10 and 30 are closed to prevent flowage of the refrigerant toward the outdoor heat exchangers 3 and 23.

During a heating operation, among the outdoor units, there may be an outdoor unit requiring a defrosting operation.

Figure 3:
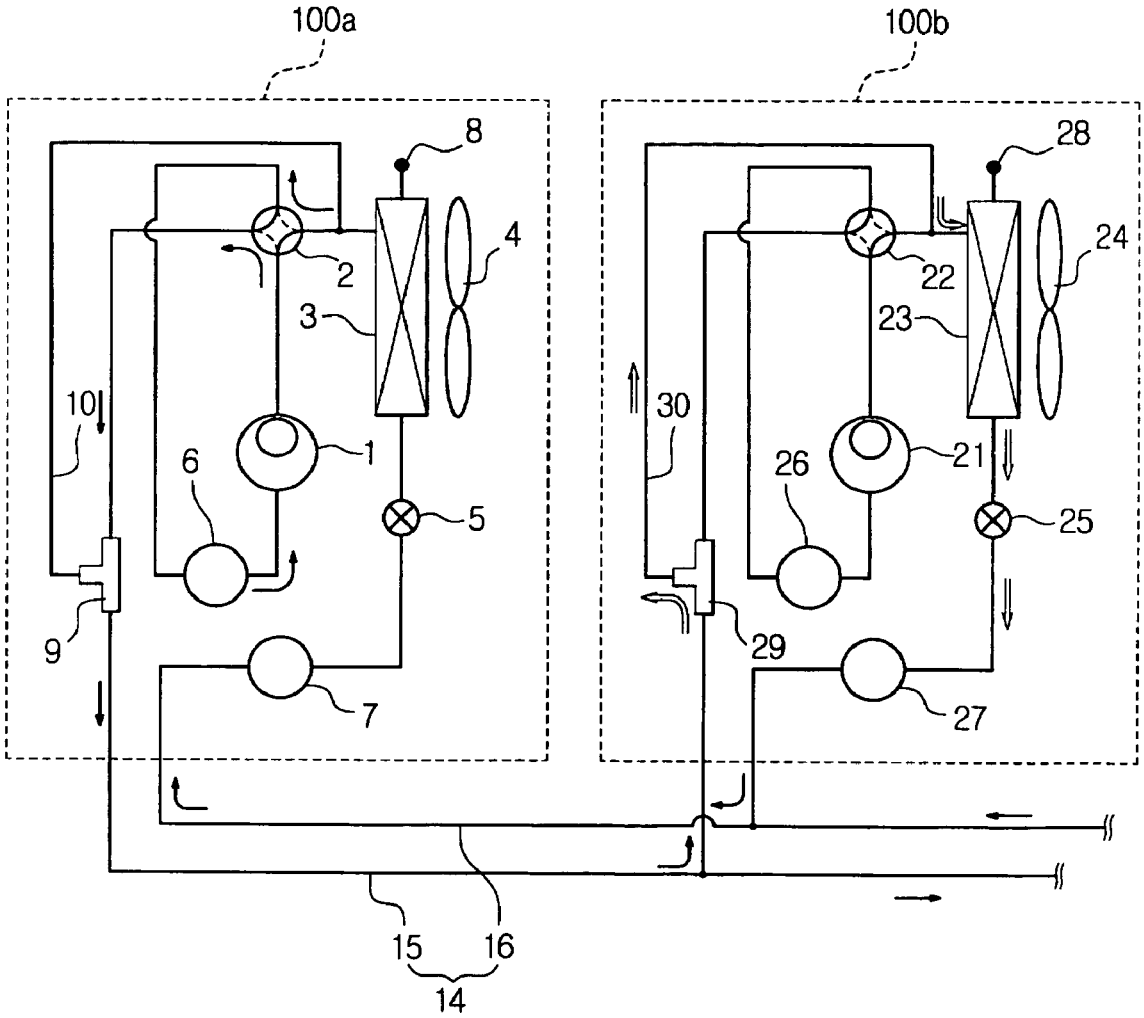
FIG. 3 is a view showing the flow of refrigerant in the air conditioner of FIG. 1 in response to one outdoor unit being operated in a heating mode while the other outdoor unit is operated in a defrosting mode.

FIG. 3 shows the first and second outdoor units 100*a* and 100*b*, in which the first outdoor unit 100*a* is operated in a heating mode while the second outdoor unit 100*b* is operated in a defrosting mode.

According to the multi air conditioner according to this embodiment of the present invention, it is possible to carry out different operations coincidentally, such that an outdoor unit which requires a defrosting operation is operated in a defrosting mode, while the other outdoor unit, which is capable of carrying out a heating operation, is operated in a heating mode. Refrigerant discharged from the first outdoor unit 100*a* operating in a heating mode is used to remove frost formed on the outdoor heat exchanger of the second outdoor unit 100*b*.

In the first outdoor unit 100*a*, the high-temperature gas refrigerant, which is discharged from the compressor 1, is discharged into the common gas pipe 15 through the four-way valve 2 and the three-way valve 9. The gas refrigerant, which has been discharged into the common gas pipe 15, is subjected to heat exchange in an indoor heat exchanger 11 of an indoor unit requiring a heating operation, and is then introduced into the common liquid pipe 16. By this circulation of the refrigerant, a room equipped with the indoor unit is heated.

When the first outdoor unit 100*a* is operated in a heating mode, the compressor 21 in the second outdoor unit 100*b* is turned off, and the three-way valve 29 is set to permit the high-temperature gas refrigerant flowing in the common gas pipe 15 to flow toward the outdoor heat exchanger 23. The high-temperature gas refrigerant, which has passed through the three-way valve 29, flows to an inlet of the outdoor heat exchanger 23 through the bypass line 30, thus causing frost formed on a piping of the outdoor heat exchanger 23 to melt.

The liquid refrigerant, which has passed through the outdoor heat exchanger 23, passes through the outdoor expansion valve 25. At this point, the outdoor expansion valve 25 is opened to an opening level of 100%, so as to allow a large amount of liquid refrigerant to pass therethrough. The liquid refrigerant, which has passed through the outdoor expansion valve 25, flows to the common liquid pipe 16 through the receiver 27, where the liquid refrigerant interflows with the liquid refrigerant returning from the indoor unit. The interflowed liquid refrigerant is changed into a low-pressure gas refrigerant while passing through the receiver 7, the outdoor expansion valve 5, and the outdoor heat exchanger 3 of the first outdoor unit 100*a*, and is returned to the compressor 1 through the accumulator 6.

When a temperature of the outdoor heat exchanger 23, which is detected by the sensor 28, reaches a predetermined defrosting-release temperature during a defrosting operation of the outdoor unit 100*b*, the multi air conditioner releases the defrosting operation and is returned to a heating operation.

Figure 4:
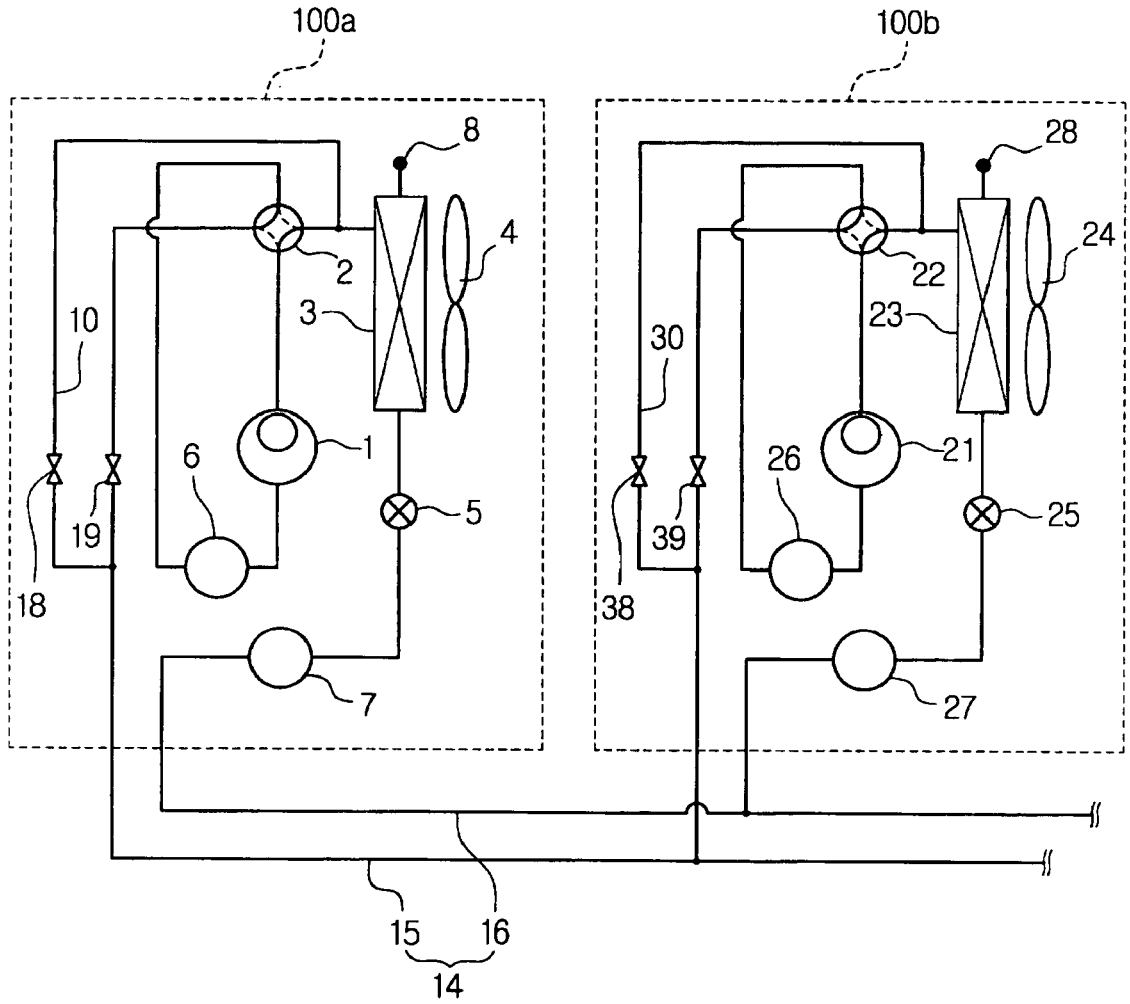
FIG. 4 is a view showing an air conditioner according to another embodiment of the present invention.

FIG. 4 shows a refrigerating cycle of a multi air conditioner according to another embodiment of the present invention, in which two valves serve the function of the three-way valve of the previous embodiment shown in FIG. 3.

As shown in FIG. 4, each of the outdoor units includes a pair of valves, which are operated in the opposite manners. First valves 18 and 38 are mounted on midpoints of the bypass lines 10 and 30, and second valves 19 and 39 are mounted between the common gas pipe 15 and the four-way valves 2 and 22.

Figure 5:
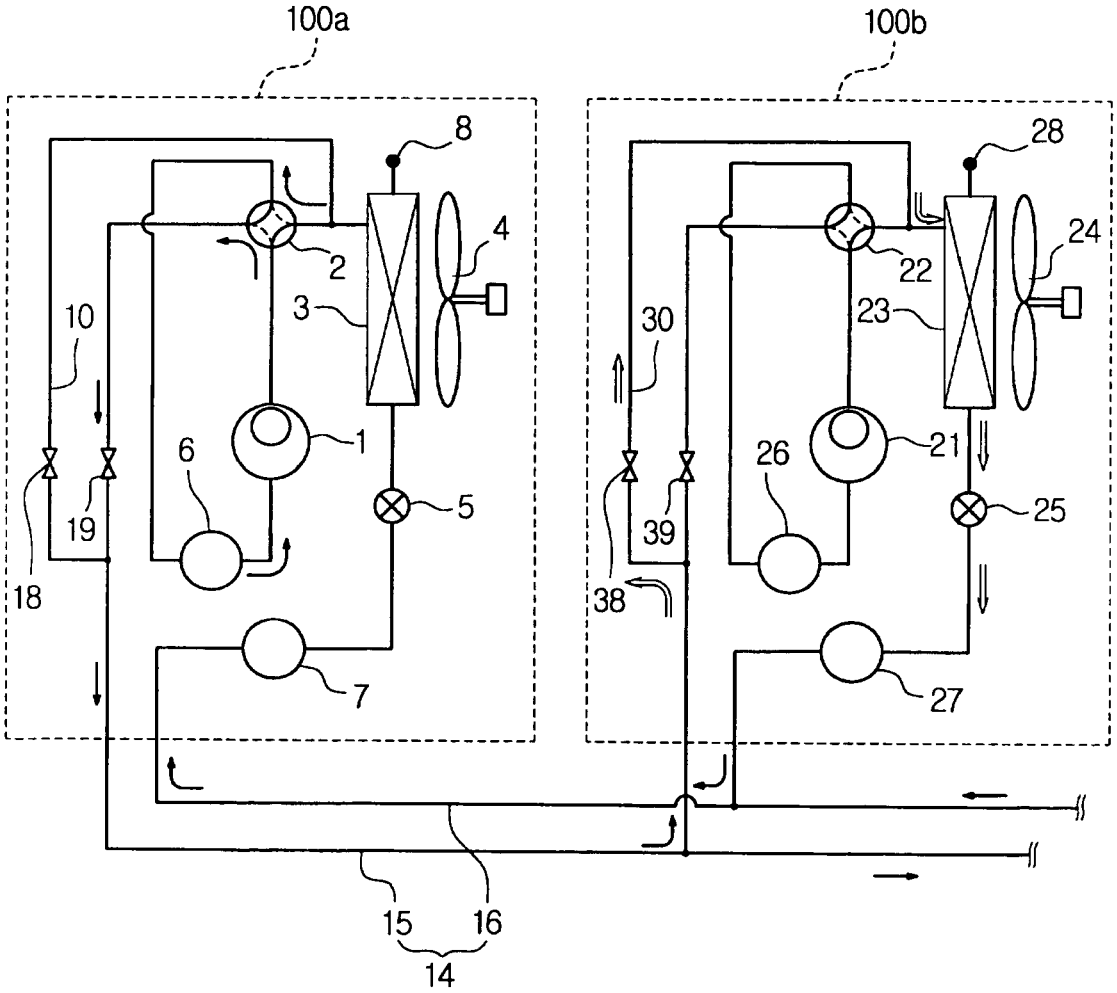
FIG. 5 is a view showing the flow of refrigerant in the air conditioner of FIG. 4 in response to one outdoor unit being operated in a heating mode while the other outdoor unit is operated in a defrosting mode.

FIG. 5 shows the first outdoor unit 100*a* and the second outdoor unit 100*b*, in which the first outdoor unit 100*a* is operated in a heating mode and the second outdoor unit 100*b* is operated in a defrosting mode.

In the first outdoor unit 100*a*, the first valve 18 is closed and the second valve 19 is opened. High-temperature gas refrigerant, which is discharged from the compressor 1, is discharged to the common gas pipe 15 through the second valve 19. Subsequently, the gas refrigerant passes through an indoor heat exchanger of an indoor unit, which requires a heating operation, and is returned to the first outdoor unit 100*a* through the common liquid pipe 16. By this circulation of the refrigerant, a room equipped with the indoor unit is heated.

In the second outdoor unit 100*b*, the first valve 38 is opened, the second valve 39 is closed, and the compressor 21 is turned off. High-temperature gas refrigerant, which is discharged into the common gas pipe 15 from the first outdoor unit 100*a*, flows to an inlet of the outdoor heat exchanger 23 through the first valve 38 mounted on the bypass line 30. As a result, frost formed on pipes of the outdoor heat exchanger 23 is melted.

The liquid refrigerant, which has passed through the outdoor heat exchanger 23, passes through the opened outdoor expansion valve 25. At this point, the outdoor expansion valve 25 is opened to an opening level of 100%, so as to allow a large amount of liquid refrigerant to pass therethrough. The liquid refrigerant, which has passed through the outdoor expansion valve 25, flows to the common liquid pipe 16 through the receiver 27, where the liquid refrigerant interflows with the liquid refrigerant returning from the indoor unit. The interflowed liquid refrigerant is changed into low-pressure gas refrigerant while passing through the receiver 7, the outdoor expansion valve 5, and the outdoor heat exchanger 3 of the first outdoor unit 100*a*, and is returned to the compressor 1 through the accumulator 6.

When a temperature of the outdoor heat exchanger 23, which is detected by the sensor 28, reaches a predetermined defrosting-release temperature during a defrosting operation of the outdoor unit 100*b*, the multi air conditioner releases the defrosting operation and is returned to a heating operation, as shown in FIG. 2.

Figure 6:
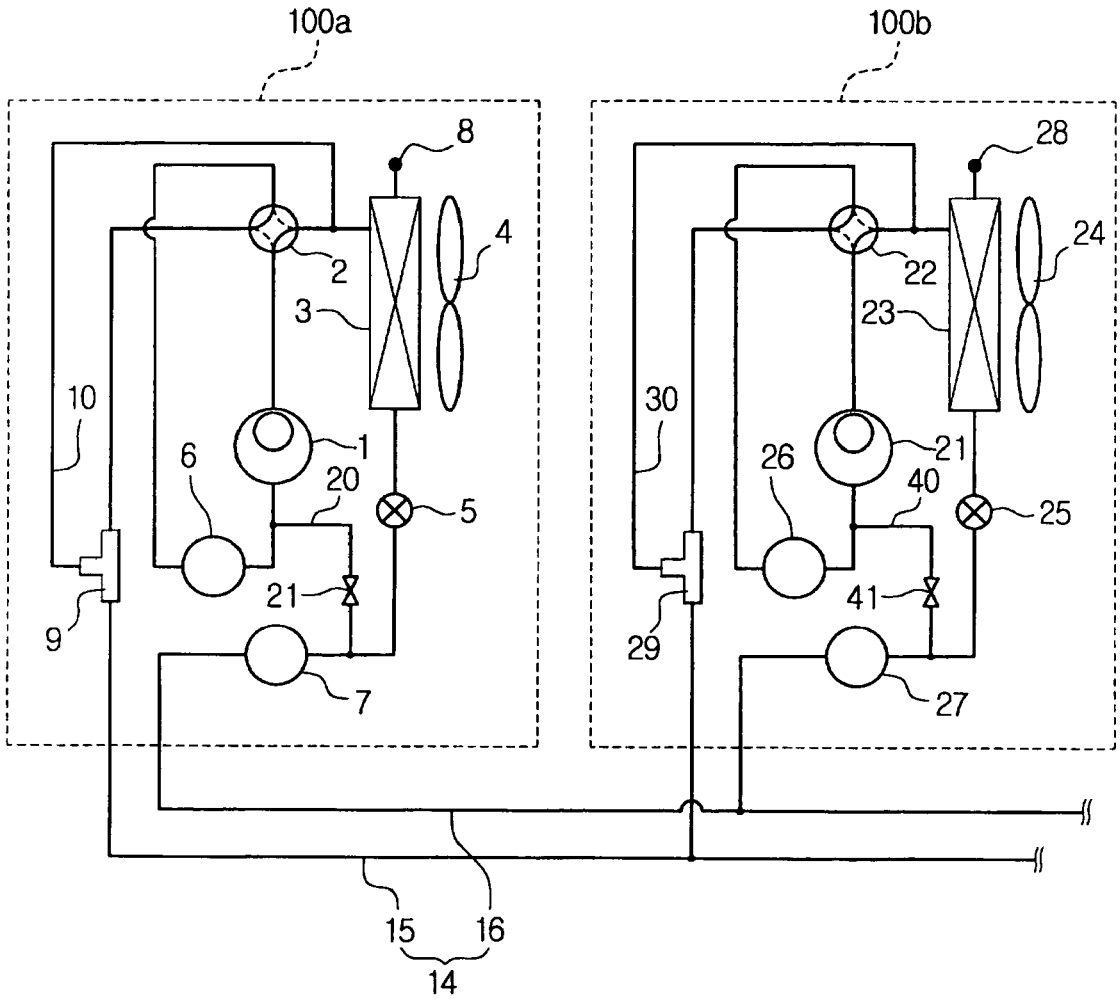
FIG. 6 is a view showing an air conditioner according to still another embodiment of the present invention.

FIG. 6 shows a refrigerating cycle of a multi air conditioner according to still another embodiment of the present invention, in which second refrigerant guide units are additionally provided to the construction shown in FIG. 3, so that an outdoor unit is able to circulate refrigerant inside itself. In this embodiment, each of the second refrigerant guide units includes a second bypass line 20 or 40 and a third valve 21 or 41.

As shown in FIG. 6, the second bypass lines 20 and 40 are connected such that liquid refrigerant, which has passed through the outdoor expansion valves 5 and 25 connected to outlets of the outdoor heat exchangers 3 and 23, flows through the second bypass lines 20 and 40 to suction inlets of compressors 1 and 21. The third valves 21 and 41 are mounted on midpoints of the second bypass lines 20 and 40.

Figure 7:
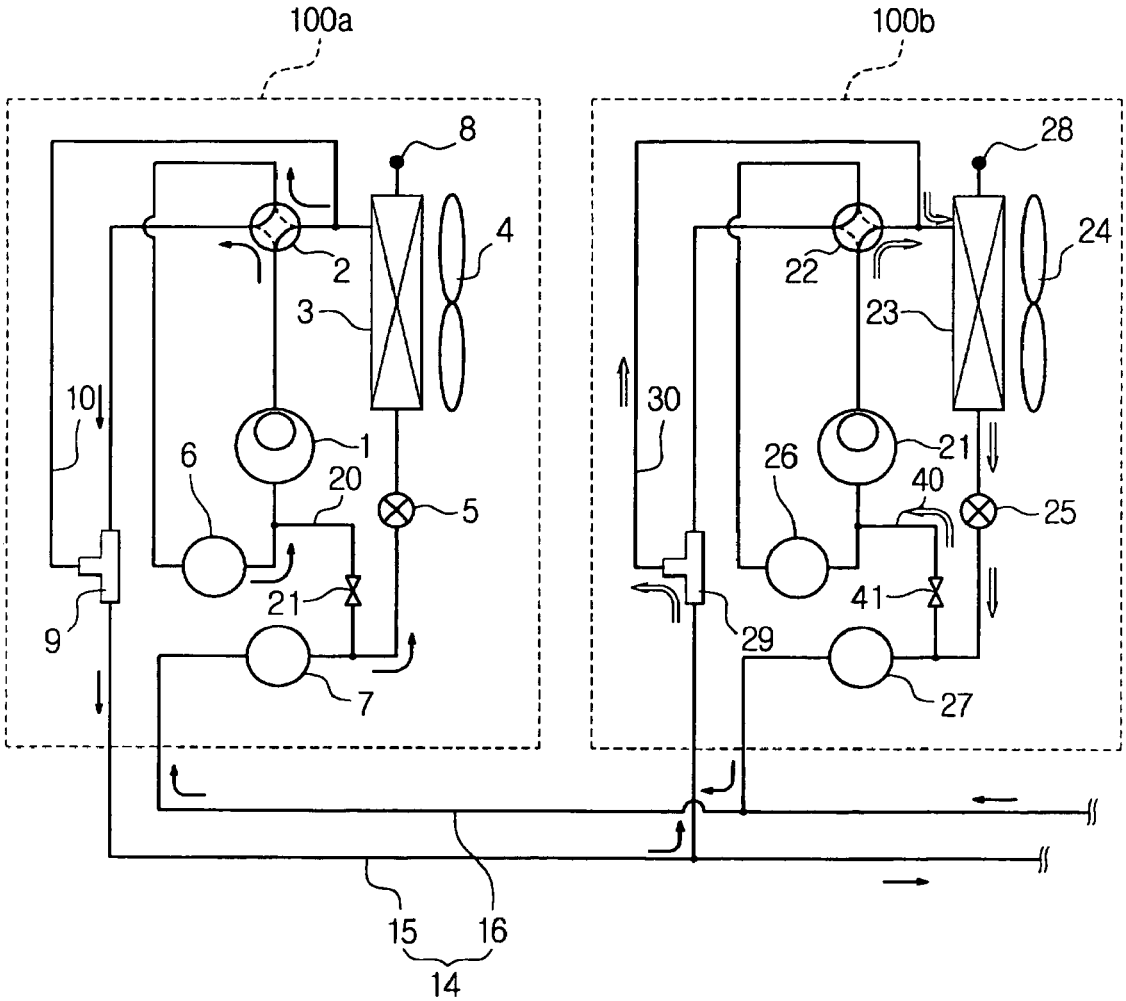
FIG. 7 is a view showing the flow of refrigerant in the air conditioner of FIG. 6 in response to one outdoor unit being operated in a heating mode while the other outdoor unit is operated in a defrosting mode.

FIG. 7 shows the first outdoor unit 100*a* and the second outdoor unit 100*b*, in which the first outdoor unit 100*a* is operated in a heating mode and the second outdoor unit 100*b* is operated in a defrosting mode.

In the first outdoor unit 100*a*, high-temperature gas refrigerant, which is discharged from the compressor 1, is discharged to the common gas pipe 15 through the four-way valve 2 and the three-way valve 9. Subsequently, the gas refrigerant is subjected to heat exchange in an indoor heat exchanger 11 of an indoor unit, which requires a heating operation, and is returned to the first outdoor unit 100*a* through the common liquid pipe 16. By this circulation of the refrigerant, a room equipped with the indoor unit is heated. At this point, the third valve 21, mounted on the midpoint of the bypass line 20, is closed.

In FIG. 7, while the first outdoor unit 100*a* is operated in a heating mode, the three-way valve 29 in the second outdoor unit 100*b* is set to allow the high-temperature gas refrigerant to flow to the outdoor heat exchanger 23. At the same time, the compressor 21 is operated and the third valve 41 is opened. The high-temperature gas refrigerant, which has passed through the three-way valve 29, flows to the inlet of the outdoor heat exchanger 23 through the first bypass line 30. At this point, the outdoor expansion valve 25 is completely opened. A major part of the liquid refrigerant, which has passed through the outdoor expansion valves 25, flows to the receiver 27, and the remaining part of the liquid refrigerant flows to the suction inlet of the compressor 21 through the second bypass line 40. The liquid refrigerant introduced in the compressor 21 is vaporized by a compression motor, thus creating a refrigerant containing a liquid phase and a gas phase. The refrigerant having the mixed phases is compressed and discharged.

In this embodiment, the compressor 21 may include a scroll compressor, which is capable of compressing liquid refrigerant and has a variable capacity. At this time, a compression ratio of the compressor is set to be lower than that in a normal operation (a heating operation) in consideration of the compression of the liquid refrigerant.

As such, since a part of the liquid refrigerant is circulated in the second outdoor unit 100*b* by drive of the compressor 21, an amount of refrigerant flowing in the first bypass line 30, diverging from the common gas pipe 15, is reduced, while an amount of refrigerant flowing to the indoor unit through the common gas pipe 15 is increased. That is, even though a relatively small amount of refrigerant is introduced into the first bypass line 30, a favorable defrosting efficiency is obtained by the circulation through the second bypass line 40. In addition, since an amount of refrigerant feeding to the inlet of the high-pressure outdoor heat exchanger is increased due to the drive of the compressor 21, a defrosting efficiency is improved.

The high-temperature liquid refrigerant, which is sent to the inlet of the outdoor heat exchanger 23 by the compressor 21, interflows with high-temperature gas refrigerant, which has passed through the first bypass line 30. The interflowed refrigerant is introduced into the outdoor heat exchanger 23, thus melting the frost formed on the piping of the outdoor heat exchanger 23.

When a temperature of the outdoor heat exchanger 23, which is detected by the sensor 28, reaches a predetermined defrosting-release temperature during a defrosting operation of the outdoor unit 100*b*, the multi air conditioner releases the defrosting operation and is returned to a heating operation.

As apparent from the above description, the present invention provides a multi air conditioner having a plurality of outdoor units, in which an outdoor unit capable of a heating operation is operated in a heating mode while another outdoor unit requiring a defrosting operation is operated in a defrosting mode. Accordingly, the outdoor unit can carry out a stable heating operation without being affected by the defrosting operation of the other outdoor units, and it is possible to prevent the reduction of a heating efficiency due to stoppage of the heating operation.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An air conditioner having a plurality of outdoor units and a plurality of indoor units connected via a common piping to transfer refrigerant therebetween, the air conditioner comprising:

a first outdoor unit to provide heat;

a second outdoor unit to defrost a heat exchanger of the second outdoor unit; and a first refrigerant guide unit in the second outdoor unit to guide a flowing direction of the refrigerant;

wherein the refrigerant discharged from the first outdoor unit is circulated through the heat exchanger of the second outdoor unit, the second outdoor unit comprises:

a compressor to compress liquid refrigerant, and a second bypass line; and a third valve;

wherein a part of liquid refrigerant, which is transferred to the common piping from the heat exchanger, is directed to a suction inlet of the compressor through the third valve and the second bypass line.

2. The air conditioner as set forth in claim 1, wherein the first refrigerant guide unit comprises:

a first bypass line; and at least one valve to direct the refrigerant to an inlet of the heat exchanger.

3. The air conditioner as set forth in claim 2, wherein the at least one valve is a three-way valve.

4. The air conditioner as set forth in claim 3, wherein the three-way valve is provided on the first bypass line.

5. The air conditioner as set forth in claim 2, wherein the at least one valve includes first and second valves.

6. The air conditioner as set forth in claim 5, wherein at least one of the first and second valves is provided on the first bypass line.

7. The air conditioner as set forth in claim 1, wherein the compressor is a scroll compressor.

8. An air conditioner having a plurality of outdoor units and a plurality of indoor units connected via a common piping to transfer refrigerant therebetween, the air conditioner comprising:

a first outdoor unit to provide heat;

a second outdoor unit to defrost a heat exchanger of the second outdoor unit; and a first refrigerant guide unit in the second outdoor unit to guide a flowing direction of the refrigerant;

wherein the refrigerant discharged from the first outdoor unit is circulated through the heat exchanger of the second outdoor unit, the second outdoor unit further comprises a compressor to compress liquid refrigerant, and a compression ratio of the compressor is set to be lower than a compression ratio of the compressor during a heating operation.

9. The air conditioner as set forth in claim 1, wherein the second outdoor unit further comprises an expansion valve coupled to an outlet of the heat exchanger.

10. The air conditioner as set forth in claim 9, wherein the outdoor expansion valve is opened to an opening level of approximately 100% in response to the defrosting of the heat exchanger.

11. An air conditioner comprising:

a first outdoor unit to provide heat;

a first compressor in the first outdoor unit;

a second outdoor unit to defrost a heat exchanger of the second outdoor unit;

a second compressor in the second outdoor unit;

a common piping connecting the first outdoor unit and the second outdoor unit;

a first refrigerant guide unit in the second outdoor unit to guide a flowing direction of refrigerant, wherein the refrigerant compressed by the first compressor is circulated through the heat exchanger; and a second refrigerant guide unit in the second outdoor unit to guide a flowing direction of the refrigerant, wherein a part of the refrigerant circulated through the heat exchanger is circulated in the second outdoor unit, wherein the second refrigerant guide unit comprises:

a second bypass line; and a valve;

wherein the part of the refrigerant circulated in the second outdoor unit is liquid refrigerant, which is transferred to the common piping from the heat exchanger, and wherein the part of the refrigerant is directed to a suction inlet of the second compressor.

12. The air conditioner as set forth in claim 11, wherein the first refrigerant guide unit comprises:

a first bypass line diverging from the common piping and connected to an inlet of the heat exchanger; and a three-way valve provided on the first bypass line.

13. The air conditioner as set forth in claim 11, wherein the second compressor is a scroll compressor to compress liquid refrigerant.

14. The air conditioner as set forth in claim 11, wherein the second outdoor unit further comprises an expansion valve coupled to an outlet of the heat exchanger, the expansion valve being opened to an opening level of approximately 100% in response to defrosting the heat exchanger.

* * * * *